United States Patent [19]

Morita et al.

[11] Patent Number: 4,489,544

[45] Date of Patent: Dec. 25, 1984

[54] METHOD OF PIECING YARNS IN A SPINNING MACHINE UTILIZING AN AIR STREAM

[75] Inventors: Takayuki Morita, Kariya; Takahiko Tsunekawa, Aichi, both of Japan

[73] Assignee: Kabushiki Kaisha Toyoda Jidoshokki Seisakusho, Kariya, Japan

[21] Appl. No.: 521,110

[22] Filed: Aug. 8, 1983

[30] Foreign Application Priority Data

Aug. 12, 1982 [JP] Japan ..... 57-140159

[51] Int. Cl.[3] ..... D01H 15/02

[52] U.S. Cl. ..... 57/261; 57/263; 57/264

[58] Field of Search ..... 57/261-264, 57/328

[56] References Cited

U.S. PATENT DOCUMENTS

| | | | |
|---|---|---|---|
| 4,031,691 | 6/1977 | Roehrich | 57/263 |
| 4,083,171 | 4/1978 | Konig et al. | 57/263 |
| 4,098,066 | 7/1978 | Stahlecker | 57/263 X |
| 4,223,517 | 9/1980 | Husges et al. | 57/261 |
| 4,248,037 | 2/1981 | Martin et al. | 57/263 |
| 4,295,330 | 10/1981 | Pfeifer | 57/263 |
| 4,356,692 | 11/1982 | Karl et al. | 57/263 |
| 4,364,224 | 12/1982 | Dennings et al. | 57/263 |
| 4,369,620 | 1/1983 | Burysek et al. | 57/263 |

*Primary Examiner*—John Petrakes

*Attorney, Agent, or Firm*—Brooks, Haidt, Haffner & Delahunty

[57] ABSTRACT

Yarns are pieced in a spinning machine utilizing an air stream, such as an open-end spinning machine or an air-jet spinning machine. For yarn piecing, an end of a yarn unwound from a bobbin is inserted into a twisting mechanism, and a sliver is newly supplied as a fleece so as to intertwine with the yarn end forming a pieced yarn portion. The thickness of the unwound yarn is detected by a detector and stored in a memory prior to insertion into the twisting mechanism. After the yarn and the sliver have been joined, the thickness of the pieced yarn portion is detected by the detector, and the detected thickness is compared with the stored thickness of the unwound yarn. If the thickness of the pieced yarn portion exceeds an allowable value as a result of such comparison, then the yarn is severed by a cutter, and thereafter a cut end of the yarn is pieced again with the fleece. Preferably, the sliver starts being supplied into the twisting mechanism at a timing advanced or delayed with respect to the previous timing of starting of the supply of the sliver when the yarn is to be pieced again with the fleece.

12 Claims, 9 Drawing Figures

METHOD OF PIECING YARNS IN A SPINNING MACHINE UTILIZING AN AIR STREAM

BACKGROUND OF THE INVENTION

Field of the Invention

The present invention relates to a method of piecing or joining yarns in a spinning machine utilizing an air stream, such as an open-end spinning machine or air-jet spinning machine.

It is known to join or piece yarn ends in spinning machines. The pieced yarn portion tends to be thicker or thinner than the rest of the yarn which is normally formed by the spinning machine. When yarns including such irregular pieced yarn portions are used to weave a fabric, the resultant fabric suffers from defects and a poor commercial value.

SUMMARY OF THE INVENTION

It is an object of the present invention to provide a method of piecing yarns in a spinning machine utilizing an air stream at the time of breakage of a yarn being formed or replacement of a bobbin, the method being capable of joining yarn ends into a pieced yarn portion having substantially the same thickness as that of the rest of the yarn.

Another object of the present invention is to provide a method of piecing yarns in a spinning machine of the type described while reliably preventing irregularly joined yarn portions having different thicknesses from being wound around a bobbin and woven into a fabric.

Still another object of the present invention is to provide a method of piecing yarns in a spinning machine of the type described, the method being capable of automatically setting a desired thickness for a pieced yarn portion.

Still another object of the present invention is to provide a method of piecing yarns in a spinning machine of the type referred to above, with one detector means incorporated for detecting the thickness of an unwound yarn and the thickness of a joined yarn portion.

A still further object of the present invention is to provide a method of piecing yarns in a spinning machine of the type described, the method being capable of bringing the thickness of a joined yarn portion reliably into conformity with that of a normally formed yarn by changing the timing of starting of the supply of a sliver upon piecing the yarns.

According to the present invention, the thickness of a yarn unwound from a bobbin is detected and the detected thickness is stored in a memory. An end of the unwound yarn is inserted into a twisting mechanism such as a spinning rotor or a false twisting nozzle. A newly supplied sliver intertwines with the inserted end of the unwound yarn thereby forming a pieced yarn portion, and thereafter, the thickness of the pieced yarn portion is detected and compared with the stored thickness of the unwound yarn. The unwound yarn is cut off to remove the pieced yarn portion when the thickness of the pieced yarn exceeds an allowable value as a result of the comparison. Thereafter, a cut end of the unwound yarn is pieced again with the sliver.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
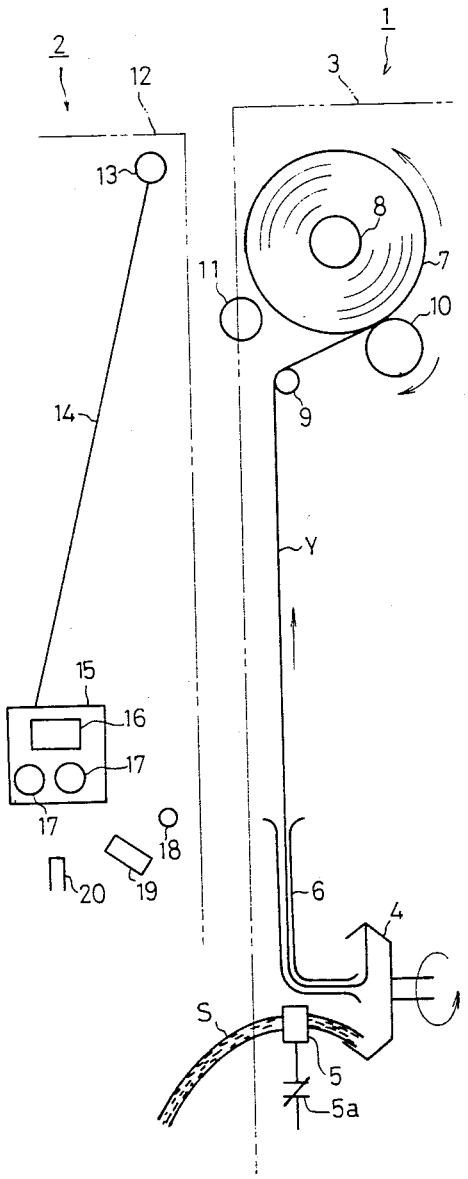
FIG. 1 is a schematic side elevationl view of an open-end spinning machine in which the method of the invention is incorporated, the spinning machine being shown as being in a spinning mode.

The present invention may be incorporated in an open-end spinning machine 1 which is one form of a spinning machine utilizing an air stream. Prior to describing the method of the present invention, the open-end spinning machine 1 and a yarn piecing machine 2 associated therewith will first be described.

The open-end spinning machine 1 has a machine frame 3 supporting on its lower portion a spinning rotor 4 serving as a twisting mechanism, a feed roller 5 for supplying a sliver S to the spinning rotor 4, and a withdrawal tube 6 for drawing and guiding upwardly a spun yarn Y from the spinning rotor 4. The feed roller 5 is rotated when a feed roller clutch 5*a* is connected.

The machine frame 3 also supports on its upper portion a bobbin 8 for forming therearound a package 7 of the spun yarn Y, a guide roller 9 positioned between the bobbin 8 and the withdrawal tube 6, and a traversing drum 10 for shaping the package 7 into a cheese.

The yarn piecing machine 2 is movable along an array of cones in the open-end spinning machine 1 and is stopped in front of a cone suffering from a yarn breakage for piecing yarn ends. The yarn piecing machine 2 includes a machine frame 12 having an angularly movably supported arm (not shown) supporting on a distal end thereof an unwinding drive roller 11 which is spaced from an outer periphery of the bobbin 8 or the package 7 during spinning. When yarn ends are to be joined together, as shown in FIGS. 2 through 6, the arm is swung to bring the unwinding drive roller 11 into contact with the lower outer peripheral surface of the bobbin 8 or the package 7 for raising the bobbin 8 or the package 7, thus causing the bobbin 8 or the package 7 to be spaced from the traversing drum 10. At this time, the unwinding drive roller 11 is rotated in a reverse direction to rotate the bobbin 8 in an unwinding direction.

Figure 2:
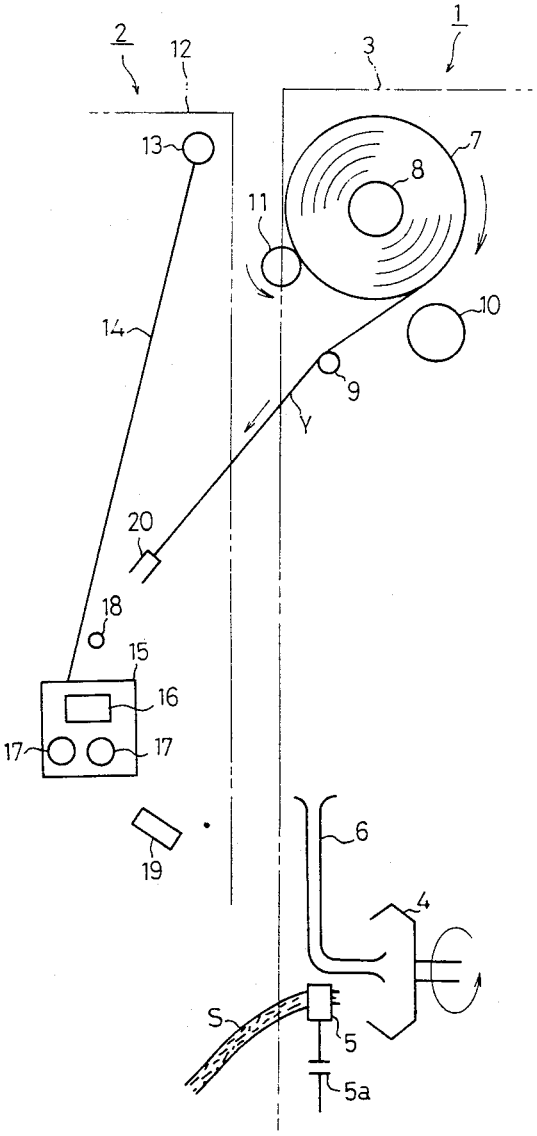
FIG. 2 is a schematic side elevational view of the open-end spinning machine, showing the manner in which a yarn is unwound from a bobbin.
Figure 3:
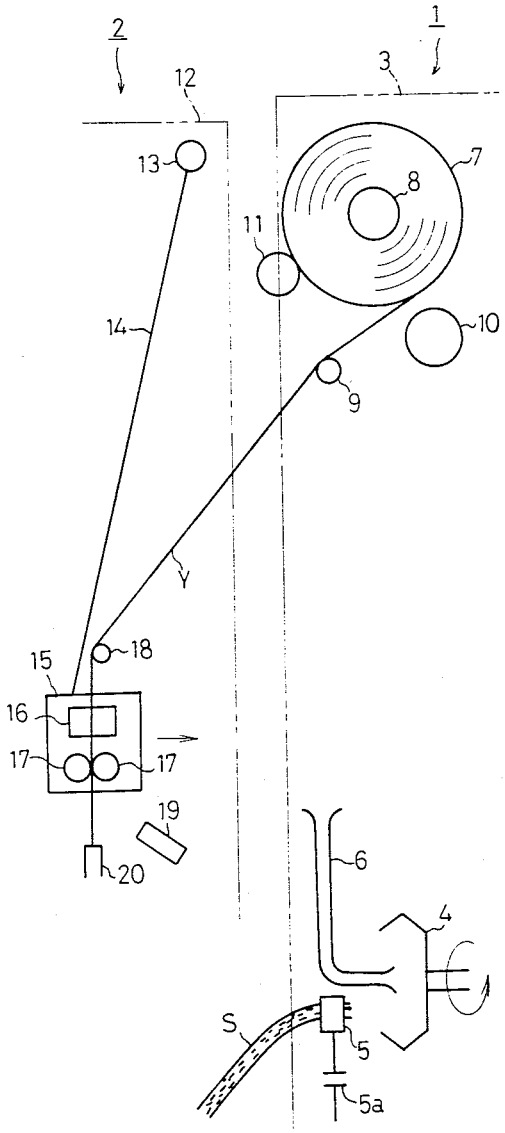
FIG. 3 is a schematic side elevational view of the open-end spinning machine, illustrating the manner in which the thickness of the unwound yarn is detected.

A support arm 14 is swingably supported by a shaft 13 at an upper end of the machine frame 12. The support arm 14 supports on a lower end thereof a detector unit 15 comprising a detector 16 for detecting the thickness of a yarn and a pair of yarn gripper rollers 17 positioned immediately below the detector 16. The machine frame 12 of the yarn piecing machine 2 also supports thereon a yarn guide 18, a cutter 19, and a suction nozzle 20. As illustrated in FIGS. 1 and 3, the yarn guide 18 is movable between a lower position and an upper position in which the yarn guide 18 guides the yarn Y from the bobbin 8 to the detector 16. As shown in FIGS. 1 through 6, the cutter 19 is movable between a lower inoperative position and an operative position below the yarn gripper rollers 17 for cutting off the yarn Y. As shown in FIGS. 2 and 3, the suction nozzle 20 is movable between an upper position above the detector unit 15 for drawing an end of the unwound yarn Y from the bobbin 8 and a lower position for drawing the unwound yarn Y through the detector unit 15. The cutter 19 is in the form of a cylindrical body having a roughened cutting surface on its outer periphery.

Figure 7:
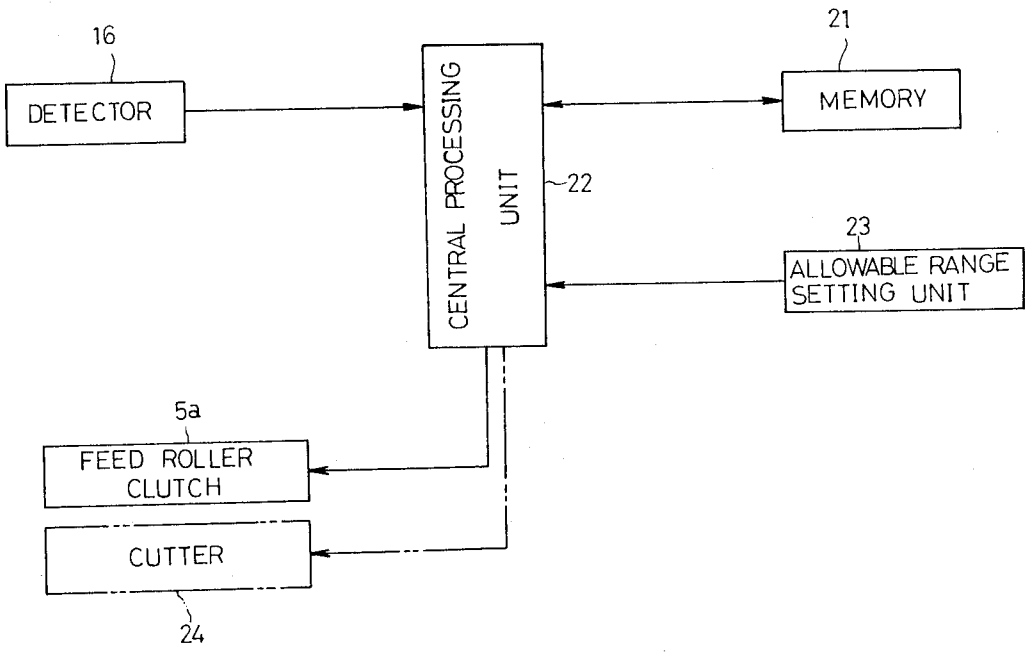
FIG. 7 is a block diagram of a yarn piecing control circuit.

Operation of the open-end spinning machine 1 and the yarn piecing machine 2, and the method of piecing yarns will be described with reference to a yarn piecing control circuit shown in FIG. 7. FIG. 1 is illustrative of a yarn spinning mode in which the spinning rotor 4 rotates at a high speed and the feed roller 5 also rotates through the connection of the feed roller clutch 5*a*. The bobbin 8 is rotated in a yarn winding direction as the traversing drum 10 is rotated. The sliver S is supplied into the spinning rotor 4 and the spun yarn Y is discharged from the spinning rotor 4 and wound as the package 7 on the bobbin 8.

The yarn piecing at the time of a yarn breakage or bobbin replacement will be effected as follows: The feed roller clutch 5*a* is disconnected as shown in FIG. 2 to stop the rotation of the feed roller 5, thereby preventing the sliver S from being supplied into the spinning rotor 4. The unwinding drive roller 11 is brought into contact with the outer periphery of the package 7 to lift the latter out of contact with the traversing drum 10. The unwinding drive roller 11 is then rotated in a reverse direction to rotate the package 7 in a yarn unwinding direction. The spinning rotor 4 in the open-end spinning machine continues to rotate in other modes than the spinning mode, except that the spinning rotor 4 is stopped when it is cleaned prior to yarn piecing.

A suction nozzle (not shown) is then actuated to draw the yarn end off the bobbin 8 to unwind the yarn from the bobbin 8. The yarn guide 18 is moved upwardly of the detector unit 15, and the unwound yarn Y is drawn by the suction nozzle 20 which has been moved to the upper position, as illustrated in FIG. 2. As shown in FIG. 3, the suction nozzle 20 is moved downwardly to pass the unwound yarn Y via the yarn guide 18 through the detector 16 to the yarn gripper rollers 17 which grip the yarn Y therebetween. At this time, the detector 16 detects the thickness of the yarn Y, and the detected thickness is stored in a memory 21 shown in FIG. 7.

The length of the yarn Y extending between the yarn gripper rollers 17 and the suction nozzle 20 is severed by the cylindrical rotatable cutter 19 which has been moved to the yarn Y. The cut end of the yarn Y is gripped by the yarn gripper rollers 17 and depends therefrom.

Figure 4:
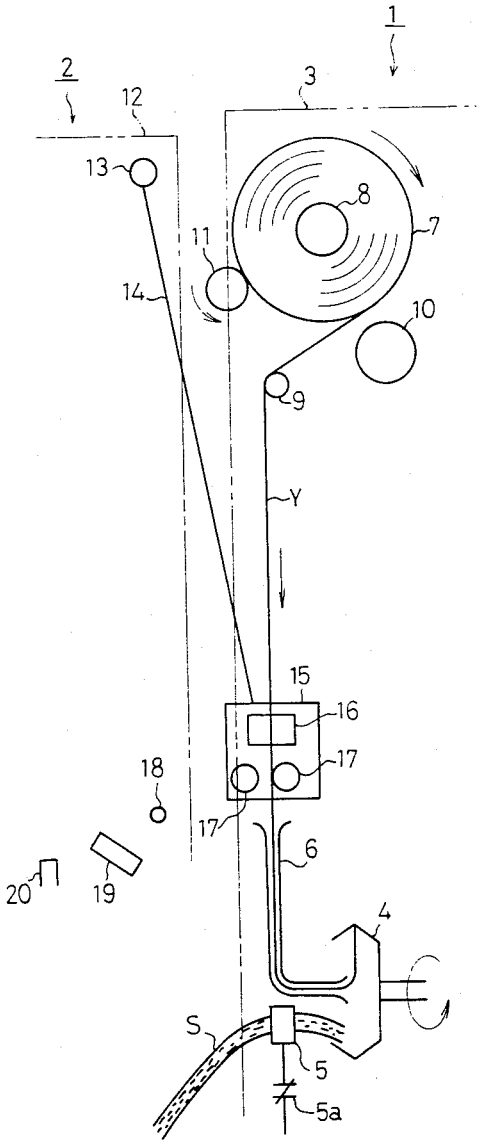
FIG. 4 is a schematic side elevational view of the open-end spinning machine, showing the position of the parts in which yarns start being pieced together.

Then, the suction nozzle 20 is deactivated, and the yarn guide 18 is retracted to the lower position. As shown in FIG. 4, the support arm 14 is swung toward the open-end spinning machine 1 to position the detector unit 15 immediately above the withdrawal tube 6. The unwinding drive roller 11 is rotated in the reverse direction to rotate the bobbin 8 in the unwinding direction, and the yarn gripper rollers 17 release the yarn Y. Under a vacuum developed in the spinning rotor 4 and the withdrawal tube 6 on rotation of the spinning rotor 4, the unwound yarn Y is drawn through the withdrawal tube 6 into the spining rotor 4 unti the yarn end of the unwound yarn Y reaches a fiber collecting surface of the spinning rotor 4.

Simultaneously, the feed roller clutch 5*a* is connected to supply the sliver S as a fleece into the spinning rotor 4. The sliver fibers in the form of the fleece are then caused to intertwine with the yarn end in the spinning rotor 4.

Figure 5:
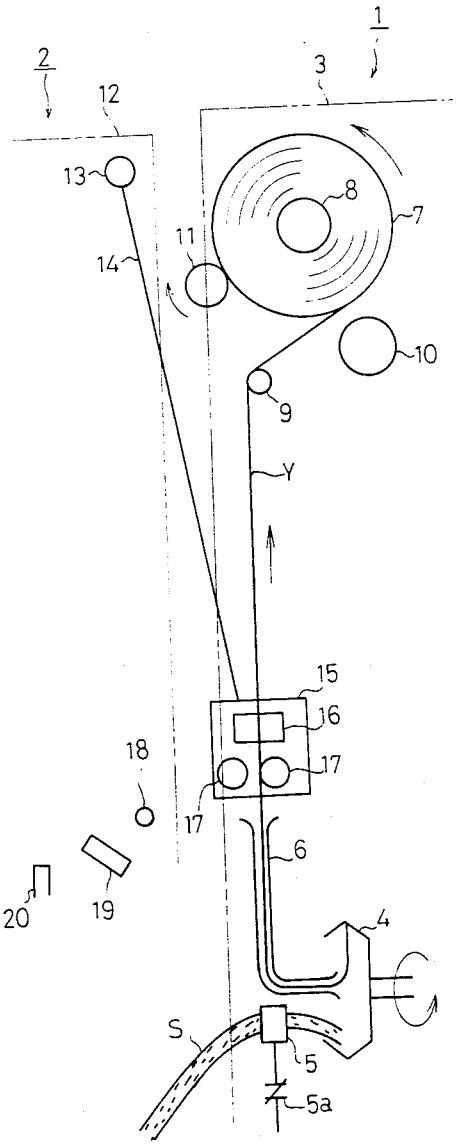
FIG. 5 is a schematic side elevational view of the open-end spinning machine, showing the parts position in which the yarns have been pieced.

Thereafter, the unwinding drive roller 11 is rotated in a normal direction, as shown in FIG. 5, to rotate the bobbin 8 in a winding direction to wind the yarn Y around the bobbin 8. The pieced yarn portion is moved past the detector 16 which detects the thickness of the pieced yarn portion. The detected thickness of the pieced yarn portion is compared in a central processing unit 22 with the stored yarn thickness from the memory 21, and any thickness difference is read out as a compared value. The control circuit also has a setting unit 23 for setting an allowable range for the compared value. The tolerable range is read into the central processing unit 22 which determines whether the detected compared value falls within the allowable range.

If the compared value is within the allowable range, that is, the thickness of the pieced yarn portion is the same as or substantially the same as the thickness as detected earlier of the yarn Y, then the support arm 14 and the unwinding drive roller 11 returns to the position of FIG. 1, and the bobbin 8 is rotated by the traversing drum 10 in a direction to wind the spun yarn Y as it traverses the package 7.

Figure 6:
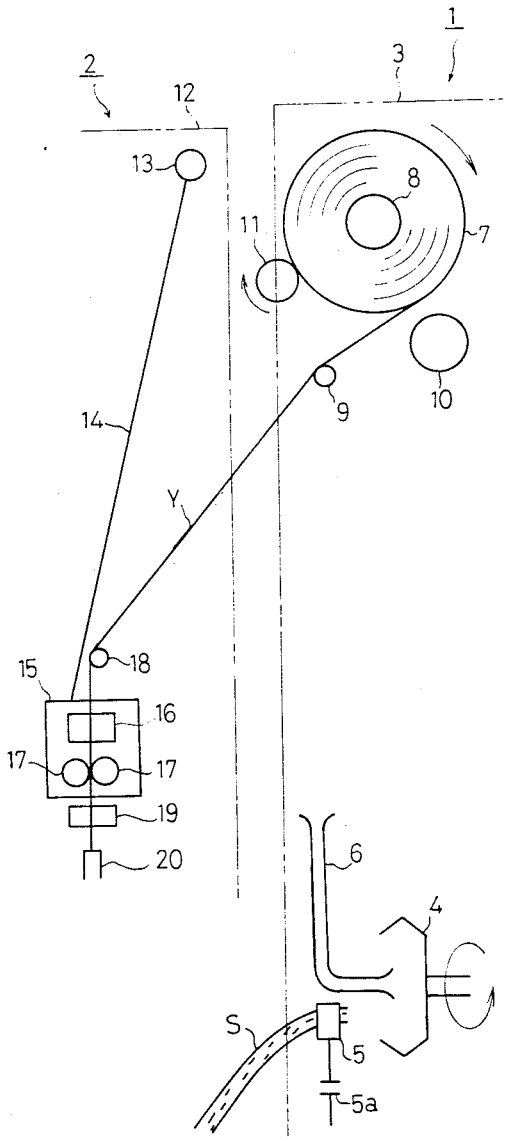
FIG. 6 is a schematic side elevational view of the open-end spinning machine, illustrating the manner in which the yarn is cut off after having been joined.

If the compared value does not fall within the allowable range, that is, the pieced yarn portion is thicker or thinner than the yarn Y, then the central processing unit 22 issues a clutch disconnecting signal in the position of FIG. 5 to disconnect the feed roller clutch 5*a* as shown in FIG. 6. The sliver S is now prevented from being supplied into the spinning rotor 4. Therefore, the yarn has a breakage, and the broken yarn end is wound on the bobbin 8. Then, the bobbin 8 is rotated in the unwinding direction by the unwinding drive roller 11, and the yarn Y is gripped by the yarn gripper rollers 17. Thereafter, the support arm 14 swings back to the yarn piecing machine 2 to allow the yarn end to be drawn by the suction nozzle 20. The pieced yarn portion is now positioned in the suction nozzle 20 as the yarn Y is unwound from the bobbin 8.

As in the previous cycle of operation, the cutter 19 is displaced to the cutting position to sever the yarn Y between the yarn gripper rollers 17 and the suction nozzle 20. Since the bobbin 8 has rotated to unwind the yarn Y, the yarn Y is cut off at a position closer than the pieced yarn portion to the bobbin 8, and the pieced yarn portion is drawn into the suction nozzle 20. Accordingly, the pieced yarn portion is cut off and does not remain on the bobbin 8.

The support arm 14 is moved again toward the spinning machine 1 to carry out yarn piecing once more in the manner described above. It is preferable for the new yarn piecing operation that the timing of connecting the feed roller clutch 5a be different from the previous timing to vary the thickness of the resulting pieced yarn portion. More specifically, if the pieced yarn portion has been too thick in the previous yarn piecing cycle, then the clutch signal is delayed to connect the feed roller clutch 5a at a delayed time or to start supplying the sliver S at a delayed time, thus thinning the pieced yarn portion. Conversely, if the pieced yarn portion has been thinner than the desired yarn, then the clutch signal is issued earlier to advance the timing of starting of the supply of the sliver S, thereby increasing the thickness of the pieced yarn portion.

Figure 8:
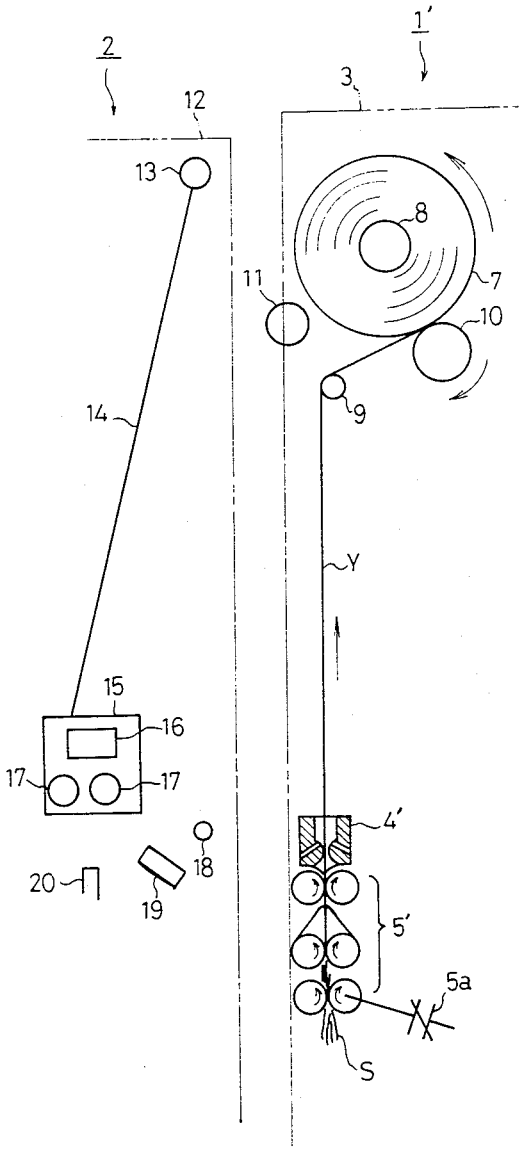
FIG. 8 is a schematic side elevational view of an air-jet spinning machine in which a method of the invention is incorporated.

The present invention is applicable to other spinning machines utilizing an air stream than the open-end spinning machine. For example, the invention can be incorporated in an air-jet spinning machine as shown in FIG. 8 which has a twisting mechanism comprising a false twisting nozzle 4' for generating a swirling stream of air therein in response to an air flow blown into the nozzle 4' to turn a fleece into a yarn in the nozzle 4'. The air-jet spinning machine is cpable of producing a fasciated yarn.

As shown in FIG. 8, the air-jet spining machine 1' has a yarn winder of the same construction as that of the open-end spinning machine 1, and a yarn piecing machine 2 is substantially the same in construction as the yarn piecing machine 2 of the open-end spinning machine 1. Identical parts shown in FIG. 8 are therefore denoted by identical reference characters in FIGS. 1 through 7.

In operation of the air-jet spinning machine 1', fibers are formed by a draft mechanism 5' into a fleece which is fed into the false twisting nozzle 4' in which the fleece is twisted by the swirling air stream into a yarn.

For joining yarns, the yarn Y goes through the detector 16 and is gripped by the yarn gripper rollers 17, then is guided upwardly of the false twisting nozzle 4'. At this time, the detector 16 detects the thickness of the yarn Y, and a detected value is stored in the memory 21 illustrated in FIG. 7. The yarn Y is inserted into the false twisting nozzle 4' by a suitable means, and the feed roller clutch 5' is connected in response to a signal applied thereto for thereby causing the fleece moving through the draft mechanism 5' to intertwine with the inserted yarn Y as a pieced yarn portion. After the pieced yarn portion has been formed, the unwinding drive roller 11 is rotated in the unwinding direction to enable the pieced yarn portion to go through the detector 16, which detects the thickness of the pieced yarn portion. The detected thickness of the pieced yarn portion is then compared with the stored yarn thickness as read out of the memory 21 in the central processing unit 22 shown in FIG. 7. The subsequent processing is the same as that of the yarn piecing method effected in the open-end spinning machine previously described.

With the yarn piecing method of the present invention, the thickness of a yarn unwound from the bobbin is detected, and yarn ends are pieced so that the thickness of a pieced yarn portion will be substantially the same as the detected thickness. Accordingly, the thickness of any pieced yarn portion can automatically be adjusted into conformity with that of a yarn on the bobbin even when the bobbin yarn is varied in thickness due to different spinning conditions.

While in the foregoing embodiments the detected thickness of a pieced yarn portion is compared with a stored yarn thickness to determine whether any thickness difference falls within an allowable range, an arrangement may be made for determining whether the detected thickness of a pieced yarn portion differs from a stored yarn thickness.

Figure 9:
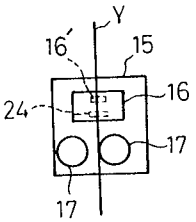
FIG. 9 is a schematic side elevationl view of another detector unit.

In the illustrated embodiments, the feed roller clutch 5a is disconnected for cutting off the yarn under a command from the central processing unit 22 when the pieced yarn portion is thicker or thinner than a desired yarn. However, a cutter 24 may be disposed in the detector 16 in the detector unit 15 as shown in FIG. 9, the cutter 24 being actuatable to sever the yarn under a command from the central processing unit 22 as shown in FIG. 7. The cutter 24 is located directly below a detector element 16' positioned along a yarn passage for detecting a yarn.

As described above with reference to the illustrated embodiments, the thickness of the yarn unwound from a bobbin is detected by a detector prior to insertion into a twisting mechanism and a detected value is stored in a memory. Then, the thickness of a pieced yarn portion is detected, and the detected thickness is compared with the stored value. If any thickness difference is greater than an allowable range, then the yarn is cut off by a cutter and yarns are pieced together again. Since the thickness of the pieced yarn portion is not compared with a predetermined thickness setting, but with the thickness of a yarn being spun, the thickness setting can automatically be established. There is no tendency of irregular pieced yarn portions having different thicknesses to be wound around a bobbin and to be woven into a fabric.

With the present invention, furthermore, when an unwound yarn and a fleece are to be joined together after the yarn has been cut off by a cutter, the timing of starting of the supply of a sliver may be delayed or advanced with respect to the previous timing depending upon the result of the comparison of yarn thicknesses, whereby the thickness of pieced yarn portions can always be brought into substantial conformity with that of the rest of the yarn.

Although certain preferred embodiments have been shown and described, it should be understood that many changes and modifications may be made therein without departing from the scope of the appended claims.

What is claimed is:

1. A method of piecing yarns in a spinning machine utilizing an air stream and having a twisting mechanism for twisting a sliver supplied therein into a spun yarn and a bobbin for winding the spun yarn therearound, said method comprising the steps of:

detecting the thickness of the yarn unwound from said bobbin and storing the detected thickness in a memory;

inserting an end of the unwound yarn into said twisting mechanism;

causing a newly supplied sliver to intertwine with the inserted end of the unwound yarn thereby forming a pieced yarn portion;

thereafter, detecting the thickness of the pieced yarn portion;

comparing the detected thickness of the pieced yarn portion with the stored thickness of the unwound yarn;

cutting off the unwound yarn when the thickness of the pieced yarn exceeds an allowable value as a result of the comparing step; and thereafter, piecing a cut end of the unwound yarn with said sliver.

2. A method according to claim 1, wherein said sliver is supplied by supply means including a clutch mechanism disconnectable for preventing said sliver from being supplied at the time of detecting the thickness of the unwound yarn and cutting off the yarn, and connectable for supplying said sliver at the time of detecting the thickness of said pieced yarn portion and forming the pieced yarn portion after the yarn has been cut off.

3. A method according to claim 1, wherein said unwound yarn is cut off by a clutch mechanism for preventing said sliver from being supplied under a command.

4. A method according to claim 1, wherein said unwound yarn is cut off by a cutter associated with detecting means for detecting the thickness of the unwound yarn.

5. A method according to claim 1, wherein said thicknesses of said unwound yarn and said pieced yarn portion are detected by one detecting means between said bobbin and said twisting mechanism.

6. A method according to claim 5, wherein said detecting means is mounted on a yarn piecing machine and movable onto the spinning machine, said detecting means being capable of detecting the thickness of the unwound yarn on said yarn piecing machine and detecting the thickness of the pieced yarn portion on said spinning machine.

7. A method according to claim 1, wherein said detected thickness of said unwound yarn and said detected thickness of said pieced yarn portion are compared by a processing unit which reads out the detected thickness of the unwound yarn stored in said memory.

8. A method according to claim 7, wherein said processing unit detects the difference between said detected thickness of said unwound yarn and said detected thickness of said pieced yarn portion as a compared value, determines whether said compared value deviates from an allowable range or not, and issues a yarn cutting signal when said compared valued deviates from said allowable range.

9. A method according to claim 1, wherein said sliver starts being supplied in a next following yarn piecing cycle at a timing advanced or delayed with respect to the timing of starting of the supply of said sliver in a next previous yarn piecing cycle during said piecing step.

10. A method according to claim 9, wherein said sliver is supplied by supply means including a clutch mechanism connectable and disconnectable for supplying and stopping the sliver, said timing being varied by controlling said clutch mechanism to change the timing of starting of operation of said supply means.

11. A method according to claim 10, wherein said supply means also includes a feed roller operatively connected to said clutch mechanism, said twisting mechanism comprising a spinning rotor.

12. A method according to claim 10, wherein said supply means also includes a draft mechanism operatively connected to said clutch mechanism, said twisting mechanism comprising a false twisting nozzle.

* * * * *